US008403449B2

(12) United States Patent
Nishimura et al.

(10) Patent No.: US 8,403,449 B2
(45) Date of Patent: Mar. 26, 2013

(54) IMAGE RECORDING APPARATUS

(75) Inventors: Hirotake Nishimura, Kyoto (JP); Motonobu Kawabata, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 660 days.

(21) Appl. No.: 12/596,071

(22) PCT Filed: Jun. 3, 2008

(86) PCT No.: PCT/JP2008/001400

§ 371 (c)(1),
(2), (4) Date: Oct. 15, 2009

(87) PCT Pub. No.: WO2008/149545

PCT Pub. Date: Dec. 11, 2008

(65) Prior Publication Data

US 2010/0079532 A1 Apr. 1, 2010

(30) Foreign Application Priority Data

Jun. 4, 2007 (JP) ..... 2007-148148

(51) Int. Cl.
*B41J 29/38* (2006.01)

(52) U.S. Cl. ..... 347/16; 198/339.1

(58) Field of Classification Search ..... 347/16, 347/18; 198/339.1

See application file for complete search history.

(56) References Cited

U.S. PATENT DOCUMENTS

| | | | | |
|---|---|---|---|---|
| 5,429,045 | A * | 7/1995 | Karlyn et al. | 101/35 |
| 5,937,993 | A * | 8/1999 | Sheets et al. | 198/345.1 |
| 2004/0189769 | A1* | 9/2004 | Wilbur et al. | 347/102 |
| 2005/0139306 | A1* | 6/2005 | Suzuki et al. | 156/64 |

FOREIGN PATENT DOCUMENTS

| | | | |
|---|---|---|---|
| JP | 8-114923 | | 5/1996 |
| JP | 2004-237603 | | 8/2004 |
| JP | 2005-153431 | | 6/2005 |
| JP | 2005153431 | A * | 6/2005 |
| JP | 2005-324443 | | 11/2005 |
| JP | 2005-335400 | | 12/2005 |
| JP | 2006-110454 | | 4/2006 |

OTHER PUBLICATIONS

International Search Report issued Jul. 15, 2008 with English Language translation.

* cited by examiner

*Primary Examiner* — Charlie Peng
*Assistant Examiner* — Peter Radkowski
(74) *Attorney, Agent, or Firm* — Ostrolenk Faber LLP

(57) ABSTRACT

A table made of a planar member has a suction groove for sucking and holding a recording medium on a surface thereof. A part of the sucking groove is perforated to form a suction hole. The suction hole is connected to a vacuum pump. The table includes three position determining pins that are in contact with two mutually orthogonal sides of a recording medium. The position determining pins are configured to ascend and descend by driving of an air cylinder between a descending position in which an upper end of the position determining pins is lower than a surface of the table and a position determining position in which the upper end of the position determining pins is higher than the surface of the recording medium mounted on the table. It is therefore made possible to provide an image recording apparatus capable of executing highly accurate image recording by preventing deformation of the recording medium.

7 Claims, 9 Drawing Sheets

IMAGE RECORDING APPARATUS

CROSS-REFERENCE TO RELATED APPLICATION

The present application is a 35 U.S.C. §371 national phase conversion of PCT/JP2008/001400 filed Jun. 3, 2008, and claims priority of JP2007-148148 filed Jun. 4, 2007, both incorporated herein in their entirety.

TECHNICAL FIELD

The present invention relates to an image recording apparatus for recording an image on a recording medium by relatively moving the recording medium and an inkjet head.

BACKGROUND ART

Such an image recording apparatus is described in, for example, Patent Document 1. The image recording apparatus described in Patent Document 1 is provided with a table for sucking and holding a recording medium, a position determining member used to determine a position of the recording medium on the table, a moving mechanism for relatively moving an inkjet head and the table, and a UV irradiation mechanism for irradiating ink coated on the recording medium with ultraviolet rays.

FIG. 9 is a perspective view showing such a table 100, and FIG. 10 is a schematic cross-sectional view thereof.

The table 100 has a hollow shape that defines an internal space part 103 as shown in FIG. 10. On an upper surface of the table 100, suction holes 101 for sucking and holding a recording medium P are formed. The space part 103 is also connected to a vacuum pump not shown. Further erected on the upper surface of the table 100 are position determining pins 102 for determining a position of the recording medium P.

Such an image recording apparatus is also available in the form of cooling a table by a cooling mechanism (refer to Patent Documents 2 to 4).

Patent Document 1: Japanese Unexamined Patent Publication No. 2004-237603

Patent Document 2: Japanese Unexamined Patent Publication No. 2005-324443

Patent Document 3: Japanese Unexamined Patent Publication No. 2005-153431

Patent Document 4: Japanese Unexamined Patent Publication No. 1996-114923

DISCLOSURE OF THE INVENTION

Problems to be Solved by the Invention

The UV irradiation mechanism provided with a UV lamp or the like emits not only ultraviolet rays but also infrared rays and other rays for irradiation in general, thereby the table 100 and the recording medium P are heated during printing.

Metals such as aluminum are commonly used as a material of the table 100. In contrast, plastics such as polycarbonate are used as a material of the recording medium P. Therefore, in the case where the recording medium P is irradiated with ultraviolet rays by using an UV irradiation device in a state that the recording medium P that is in contact with the position determining pins 102 in a determined position is sucked and held on the table 100, different thermal expansion coefficient between the table 100 and the recording medium P cause local deformation of the recording medium P. Deformation occurring in the recording medium P makes it impossible to execute highly accurate image recording.

The present invention was achieved to solve the above problems, having an object to provide an image recording apparatus capable of executing highly accurate image recording while preventing deformation of a recording medium.

Means Adapted to Solve the Problems

A first aspect of the present invention is characterized by an image recording apparatus for recording an image on a recording medium by relatively moving the recording medium and an inkjet head, including an inkjet head, a table for mounting the recording medium, fixing means adapted to fix the recording medium on the table, a moving mechanism for relatively moving the inkjet head and the table, a UV irradiation mechanism for irradiating ink transferred from the inkjet head to the recording medium, with ultraviolet rays, and a position determining pin ascending and descending relative to the table in order to determine a position of the recording medium on the table.

A second aspect of the present invention is based on the first aspect of the present invention, wherein the table is made of a planar member and the fixing means is a suction groove formed on a surface of the table in communication with suction means via a suction hole.

A third aspect of the present invention is based on the second aspect of the present invention, wherein the suction groove has a groove width of 0.7 mm or less and the suction hole has an inner diameter of 1.0 mm or less.

A fourth aspect of the present invention is based on the second aspect of the present invention, further having a control part for controlling a lifting mechanism for the position determining pin, wherein the control part controls the position determining pin lifting mechanism so as to maintain the position determining pin at a state of descending to a position where the position determining pin is not in contact with the recording medium at least for a period of UV irradiation to the recording medium by the UV irradiation mechanism.

A fifth aspect of the present invention is based on the fourth aspect of the present invention, wherein the control part controls the position determining pin lifting mechanism so as to raise the position determining pin to a position where the position determining pin is contactable with the recording medium for a period of absence of the recording medium on the table.

A sixth aspect of the present invention is based on the second aspect of the present invention, wherein a cooling mechanism for cooling the table is arranged on a lower surface of the table.

A seventh aspect of the present invention is based on the sixth aspect of the present invention, wherein the moving mechanism relatively moves the inkjet head and the table by causing reciprocating movement of the table in one direction and intermittent movement of the inkjet head, and the cooling mechanism has a plurality of cooling water passages extended in a direction transverse to a reciprocating movement direction of the table and a cooling water circulating mechanism for allowing cooling water to pass through the plurality of the cooling water passages on a lower surface side of the table.

An eighth aspect of the present invention is based on the seventh aspect of the present invention, including an arrangement of a plurality of units each including a cooling water passage connected at one end to a cooling water supply pipe and a cooling water passage connected at one end to a cooling water discharge pipe, the other ends of the cooling water passages being connected to one another through a pipe.

A ninth aspect of the present invention is based on the seventh aspect of the present invention, wherein the plurality of the cooling water passages are each connected at one end to a cooling water supply pipe and connected at the other end to a cooling water discharge pipe.

A tenth aspect of the present invention is based on the ninth aspect of the present invention, wherein the table includes a supply-side cooling water passage arranged along a moving direction of the table and connected to one end of each of the plurality of the cooling water passages and a discharge-side cooling water passage arranged along the moving direction of the table and connected to the other end of each of the plurality of the cooling water passages, and the supply-side cooling water passage and the discharge-side cooling water passage are arranged at both ends in a direction orthogonal to the moving direction of the table.

An eleventh aspect of the present invention is based on the tenth aspect of the present invention, wherein the supply-side cooling water passage or the discharge-side cooling water passage is arranged on an outer side of the position determining pin in the table.

EFFECT OF THE INVENTION

The first aspect of the present invention makes it possible to execute highly accurate image recording while preventing deformation of a recording medium.

The second aspect of the present invention allows prevention of a temperature rise in the table and also realizes the fixing means in a simple configuration.

The third aspect of the present invention makes it possible to prevent deterioration of printing quality due to temperature non-uniformity in the recording medium.

The fourth aspect of the present invention ensures prevention of deformation of the recording medium resulting from irradiation with ultraviolet rays.

The fifth aspect of the present invention ensures prevention of positional deviation of a recording medium accompanied by a rising operation in the position determining pin.

The sixth aspect of the present invention makes it possible to reduce temperature non-uniformity by reducing a temperature rise in the table.

The seventh aspect of the present invention allows a temperature rise in cooling water to be dispersed into the plurality of the cooling water passages owing to a configuration that a table is cooled by the plurality of the cooling water passages extended in a direction transverse to a reciprocating movement direction of the table.

The eighth aspect of the present invention allows each of the units to share the cooling function for the table and makes it possible to equalize a temperature rise in cooling water in each of the units because of the arrangement of a plurality of units each including the cooling water passage connected at one end to the cooling water supply pipe and the cooling water passage connected at one end to the cooling water discharge pipe, the other ends of the cooling water passages being connected to one another through the pipe.

The ninth aspect of the present invention allows each of the cooling water passages to share the cooling function for the table and makes it possible to equalize a temperature rise in cooling water in each of the cooling water passages because the plurality of the cooling water passages are connected at one end to the cooling water supply pipe and connected at the other end to the cooling water discharge pipe.

The tenth aspect of the present invention enables to make the device compact while preventing a heat gradient at the center of the table owing to the arrangement of the supply-side cooling water passage and the discharge-side cooling water passage at both ends in a direction orthogonal to a moving direction of each table.

The eleventh aspect of the present invention makes it possible to prevent effects of a heat gradient with respect to a recording medium owing to the arrangement of the supply-side cooling water passage or the discharge-side cooling water passage on an outer side of the position determining pin.

BEST MODE FOR CARRYING OUT THE INVENTION

Embodiments of the present invention will be explained below based on drawings. FIG. 1 is a perspective view of an image recording apparatus according to the present invention.

This image recording apparatus includes a main body frame 30, a table 20 for mounting a recording medium P2, a pair of main scanning guides 32 arranged in the main body frame 30 in order to allow reciprocating movement of the table 20 in X+ and X− directions, an auxiliary shaft frame 33, a recording head 12 having an inkjet head 10 and a UV irradiation mechanism 11, and a pair of auxiliary shaft guides 31 arranged in the auxiliary shaft frame 33 in order to move the recording head 12 in a Y direction.

The inkjet head 10 includes a yellow inkjet head 10Y for discharging yellow ink, a magenta inkjet head 10M for discharging magenta ink, a cyan inkjet head 10M for discharging cyan ink, and a black inkjet head 10K for discharging black ink. Also arranged in the UV irradiation mechanism 11 is a pair of discharge ducts 13 which constitute part of a cooling mechanism therefor.

In recording an image by the image recording apparatus, ink is discharged from the inkjet heads 10Y, 10M, 10C and 10K while moving the table 20, which mounts the recording medium P2, in the X+ direction. The ink discharged from the inkjet heads 10Y, 10M, 10C and 10K and coated on the recording medium P2 is fixed by receiving ultraviolet rays irradiated from the UV irradiation mechanism 11. Once the table 20 is moved to its stroke end in the X+ direction, the table 20 is moved to the X− direction. The recording head 12 is also moved over a minute distance in the Y direction.

The image recording apparatus is thus configured to record an image in the recording medium P2 by causing reciprocating movement of the recording medium P along with the table 20 in a horizontal scanning direction (i.e. X direction in FIG. 1) and intermittent movement of the recording head 12 in a vertical scanning direction (i.e. Y direction in FIG. 1).

Such an operation is executed by a control part 50 as shown in FIG. 3 which controls the inkjet head 10 and the UV irradiation mechanism 11 as well as an air cylinder 24 and a vacuum pump 20, described later.

Next, description will be made of the configuration of the table 20, which is a characteristic part of the present invention. FIG. 2 is a perspective view of the table 20 and other components, and FIG. 3 is a schematic cross sectional view thereof. Note that a cooling mechanism described later is omitted in FIGS. 1 and 2.

The table 20 is made of a planar member with its surface provided with four suction grooves 22 for sucking and holding the recording medium. Each of the suction grooves 22 is in a cross-in-square shape, which has a crisscross arranged in a rectangle. A portion corresponding to the center of each of the suction grooves 22 is perforated to form a suction hole 23.

The suction hole 23 is connected to the vacuum pump 29 as shown in FIG. 3. One of the regions of the four the suction grooves 22 is used to suck and hold the recording medium P1, which has a minimum size. All the regions of the four suction grooves 22 are used to suck and hold the recording medium P2, which has a maximum size.

Note that the suction groove 22 has a groove width of 0.7 mm or less. The suction hole 23 also has an inner diameter of 1.0 mm or less. Such configurations make it possible to prevent deterioration of printing quality caused by temperature non-uniformity in the recording media P1 and P2. The temperature non-uniformity, as used herein, refers to a local temperature difference on the table 20.

Also arranged on the table 20 are three position determining pins 21 that are in contact with the recording media P1 and P2 at two mutually orthogonal sides thereof. Each of the position determining pins 21 is configured to ascend and descend by driving of the air cylinder 24 between a descending position in which an upper end of the position determining pin is lower than the surface of the table 20 and a position determining position in which the upper end of the pin is higher than the surfaces of the recording media P1 and P2 mounted on the table 20.

The table 20 having such a configuration first causes the position determining pins 21 to ascend to the position determining position, followed by determining the position of the recording media P1 and P2 by the position determining pins. Then, the vacuum pump 29 is activated to suck and hold the recording media P1 and P2 on the surface of the table 20 using the suction holes 23 and the suction grooves 22. Then, the position determining pins 21 are made to descend to the descending position.

This makes the recording medium P1 (or P2) out of contact with the position determining pins 21 during image recording. This operation will be described in detail later.

Next, description will be made of the configuration of a cooling mechanism. FIG. 4 is a perspective view showing a lower surface of the table 20 which employs a cooling mechanism according to a first embodiment, and FIG. 5 is a plan view thereof. Note that the position determining pins 21 and the air cylinder 24 are omitted in FIG. 4.

On the lower surface side of the table 20, the cooling mechanism for cooling the table 20 includes a plurality of cooling water passages 41 of cooling jackets extensive in a direction (i.e. Y direction) orthogonal to a reciprocating movement direction (i.e. X direction) of the table 20. The cooling water passage 41 arranged at one end in the reciprocating movement direction of the table 20 is connected to a pipe for supplying cooling water, and the cooling water passage 41 arranged at the other end is connected to a pipe for discharging cooling water. The cooling water passages 41 are also connected to each other through tubes 42. Using such a cooling mechanism to cool the table 20 reduces a rise in the temperature of the table 20 and reduces the temperature non-uniformity.

In this regard, in the present embodiment, the rise in the temperature of the cooling water can be dispersed through the plurality of the cooling water passages 41 particularly because the cooling water passages 41 are arranged in the direction (i.e. Y direction) orthogonal to the reciprocating movement direction (X direction) of the table 20. The table 20 can be therefore cooled efficiently.

In contrast, if the cooling water passages 41 are arranged in the reciprocating movement direction (i.e. X direction) of the table 20, a specific cooling water passage 41 is exclusively heated in recording an image and cooling water with raised temperature flows into the rest of the cooling water passages 41. This raises the temperature over the region of the table 20 from the specific cooling water passage 41 down to those disposed on the side of the cooling water discharge tube, resulting in temperature non-uniformity on the table 20 and causing deformation of the recording medium. Arranging the cooling water passages 41 in the direction (i.e. Y direction) orthogonal to the reciprocating movement direction (i.e. X direction) of the table 20 will make it possible to prevent such problems.

The cooling water passage described in this specification refers to a cooling mechanism in a shape of a long pipe such as a cooling jacket having a function to cool the table 20 by causing cooling water to pass through the inside thereof.

FIG. 6 is a plan view showing a lower surface of the table 20 which employs a cooling mechanism according to a second embodiment.

The cooling mechanism according to the second embodiment is configured to arrange four units each including a cooling water passage 41 connected at one end to a cooling water supply pipe 61 and a cooling water passage 41 connected at one end to a cooling water discharge pipe 62, with the other ends of the cooling water passages 41 connected to one another through a tube 42. The cooling water supplied from the cooling water supply pipe 61 passes through one of the cooling water passages 41 constituting each unit, the tube 42, and the other cooling water passage 41, and flows into the cooling water discharge pipe 62.

Also in the second embodiment, the rise in the temperature of the cooling water can be dispersed into the plurality of the cooling water passages 41 because the cooling water passages 41 are arranged in a direction (i.e. Y direction) orthogonal to a reciprocating movement direction (X direction) of the table 20. The table 20 can be therefore cooled efficiently.

Additionally, the second embodiment has the arrangement of a plurality of units each including the cooling water passage 41 connected at one end to the cooling water supply pipe 61 and the cooling water passage 41 connected at one end to the cooling water discharge pipe 62, with the other ends of the cooling water passages 41 connected to one another through the tube 42. This enables the cooling mechanism of the table 20 to be shared among the units and thus to equalize the rise in the temperature of the cooling water in the units. This in turn prevents temperature non-uniformity from occurring on the table 20 and effectively prevents deformation of the recording medium.

FIG. 7 is a plan view showing a lower surface of the table 20 which employs a cooling mechanism according to a third embodiment.

In the cooling mechanism according to the third embodiment, the table 20 arranges, on a lower surface thereof, the plurality of the cooling water passages 41 extended in the direction (i.e. Y direction) orthogonal to the reciprocating movement direction (i.e. X direction) of the table 20, a supply-side cooling water passage 43 connected to one end of each of the cooling water passages 41 via a tube 64, and a discharge-side cooling water passage 44 connected to the other ends of each of the cooling water passages 41 via a tube 65. The supply-side cooling water passage 43 is connected to a cooling water supply pipe 63. The discharge-side cooling water passage 44 is connected to a cooling water discharge pipe 66. These supply-side cooling water passage 43 and discharge-side cooling water passage 44 are arranged at both ends in a direction orthogonal to a moving direction of the table 20. In particular, the discharge-side cooling water passage 44 is arranged on an outer side of the aforementioned position determining pins 21 in the table 20.

Also in the third embodiment, the rise in the temperature of the cooling water can be dispersed into the plurality of the cooling water passages 41 because the cooling water passages 41 are arranged in the direction (i.e. Y direction) orthogonal to the reciprocating movement direction (X direction) of the table 20. The table 20 can be therefore cooled efficiently.

Additionally in the third embodiment, the plurality of the cooling water passages 41 are each connected at one end to the supply-side cooling water passage 43 and connected at the other end to the discharge-side cooling water passage 44, thereby allowing each of the cooling water passages 41 to share the cooling mechanism of the table 20 and making it possible to equalize the rise in the temperature of the cooling water in the cooling water passages 41.

Additionally in the third embodiment, the supply-side cooling water passage 43 and the discharge-side cooling water passage 44 are arranged at both ends in the direction orthogonal to the moving direction of the table 20. This makes the entire device including the table 20 compact while preventing a heat gradient at the center of the table. Additionally, the discharge-side cooling water passage 44 is arranged on an outer side of the position determining pins 21, which makes it possible to, even if a heat gradient occurs in the discharge-side cooling water passage 44, prevent influences that the heat gradient has on the recording medium. The heat gradient, as used herein, refers to a gradient of the cooling water temperature resulting from heat exchange that occurs when the cooling water passes through a heated place.

Next, description will be made of an image recording operation in the above-described image recording apparatus. FIG. 8 is a flowchart showing an image recording operation.

In response to instructions by an operator using an operation panel 51 to start image recording, the control part 50 drives the air cylinder 24 to raise the position determining pins 21 to the position determining position thereof from the descending position (step S1). Next, the recording medium P1 (or P2) is mounted on the table 20 by the operator so that the edges of two orthogonal sides of the recording medium P1 (or P2) come in contact with the three position determining pins 21, and the position of the recording medium is determined (step S2). The recording medium P1 (or P2) may also be mounted on the table 20 by a robot or the like instead of the operator. Next, the control part 50 causes the vacuum pump 24 to operate so as to suck and hold the recording medium P1 (or P2) at the determined position on an upper surface of the table 20 (step S3).

Next, the control part 5 causes the position determining pins 21 to descend to the descending position (step S4). Since the recording medium P1 (or P2) is already vacuum-sucked by the suction grooves 22 and the suction holes 23 in the step S3, the determined position on the upper surface of the table 20 is maintained even if the recording medium P1 (or P2) is out of contact with the position determining pins 21 in the step S4.

Subsequently, a two-dimensional image is recorded in the recording medium P1 (or P2) by feeding the inkjet head 10 intermittently in the Y direction while performing main scanning of the table 20 in the X+ and X− directions, and driving the inkjet head 10 based on image data (step S5).

While in the above description the image recording automatically starts after completion of descending of the position determining pins 21, the image recording may start upon instruction from an operator.

After completion of the image recording, the control part 50 causes the vacuum pump 24 to stop (step S6) to release vacuum-fixing of the recording medium P1 (or P2) on the upper surface of the table 20, and the recording medium P1 (or P2) is removed from the upper surface of the table 20 by the operator (step S7).

Then, in the case where image recording is carried out for a subsequent recording medium P1 (or P2), step S8 is determined as "YES" and the process returns to step 1. In the following step S1, the position determining pins 21 are made to protrude from the descending position to the ascending position for a period of absence of the recording medium P1 (or P2) on the upper surface of the table 20. Accordingly, an ascending operation of the position determining pins 21 from the descending position to the ascending position is not hindered by the recording medium P1 (or P2). Additionally, the ascending operation of the position determining pins 21 does not cause positional deviation of the recording medium P1 (or P2).

In the case where an image is recorded in the recording media P1 and P2 sucked and held in the table 20 in the above-described manner, deformation of the recording media P1 and P2 can be prevented even if the recording media P1 and P2 or other components are heated by irradiation of ultraviolet rays or the like emitted from the UV irradiation mechanism 11, and highly accurate image recording can be executed.

Note that following advantageous effects can be exhibited in the case of using the table 20 in comparison with the case of using the conventional table 100 shown in FIGS. 5 and 6.

Firstly, the position determining pins 21 are arranged at a height of good operability during position determination while being descendable during image recording. This enables the inkjet head 10 to be approximated to the surface of the recording media P1 and P2. In this regard, the inkjet head 10 generally has ejection angle errors that result from processing errors or other reasons, but even if such errors exist, deterioration of image recording accuracy can be reduced by approximating the inkjet head 10 to the surface of the recording media P1 and P2. The inkjet head 10 is also known to eject small droplets referred to as "a satellite" following the main droplets, but these droplets are set to arrive at a position approximate to the surface of the recording media P1 and P2 by approximating the inkjet head 10 to the surface of the recording media P1 and P2, whereby deterioration of image recording accuracy is reduced.

Secondly, thermal expansion of the table can be minimized. Specifically, in the case of using the table 100 as shown in FIGS. 5 and 6, the space part 103 in a hollow state causes a heat insulating effect and the table 100 results in having a high temperature. In contrast, the table 20 is made of a planar member and therefore does not have such a temperature rise.

Thirdly, the table 20 including the suction grooves 22 with a groove width of 0.7 mm or less and also the suction holes 23 with an inner diameter of 1.0 mm or less makes it possible to prevent deterioration of printing quality resulting from temperature non-uniformity in the recording media P1 and P2. In contrast, in the case where the table 100 in the configuration of sucking and holding the recording medium P by a multiple number of the suction holes 101 as shown in FIG. 5 and FIG. 6 is used, temperature non-uniformity is easily observed in the recording medium P, which is problematic.

Fourthly, the table 20 made of a planar member allows a simple device configuration. In contrast, in the case of using the table 100 shown in FIGS. 5 and 6, it is inevitable to result in a complicated device configuration because a hollow structure defining the space part 103 needs to be formed internally, along with the need for prevention of air leakage.

Fifthly, although the suction grooves 22 and the suction holes 23 in the table 20 are turned into a vacuum and thus become higher in temperature than the table 20, they can be cooled to a same extent as the surface of the table 20 by the present invention.

DESCRIPTION OF REFERENCE NUMERALS

Figure 1:
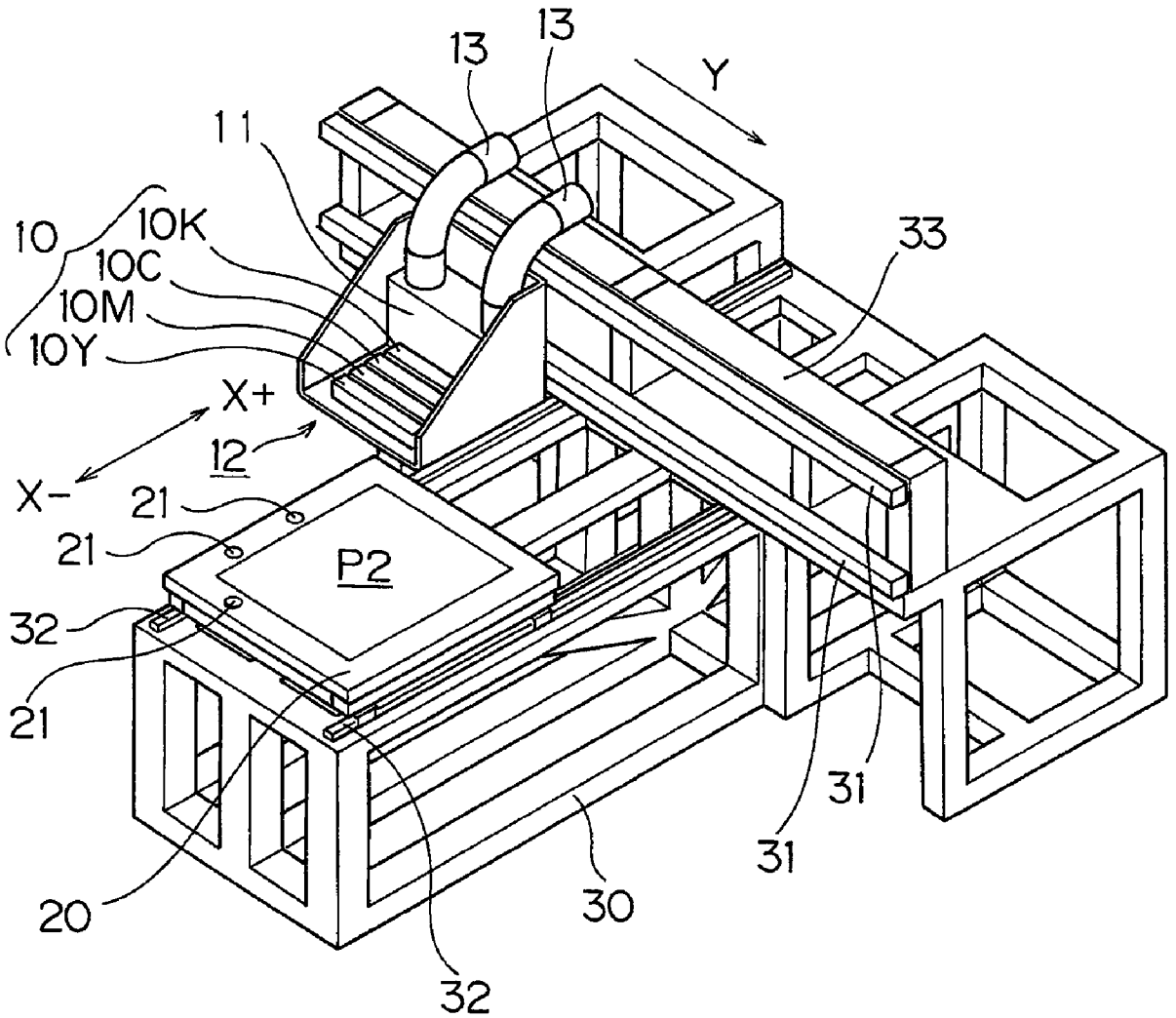
FIG. 1 is a perspective view of an image recording apparatus according to the present invention.
Figure 2:
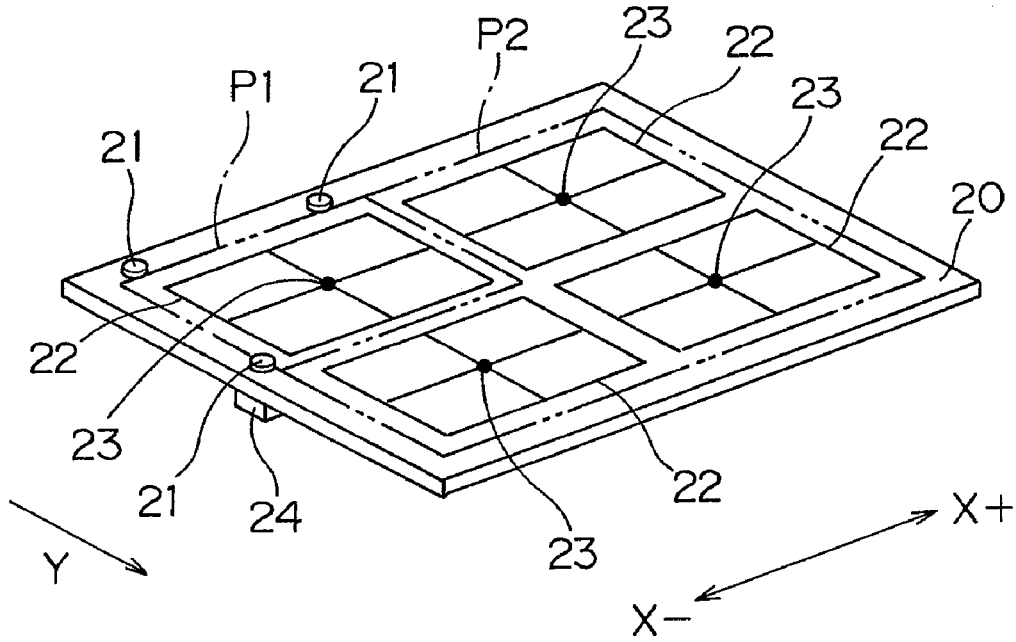
FIG. 2 is a perspective view showing a table 20 and other components.
Figure 3:
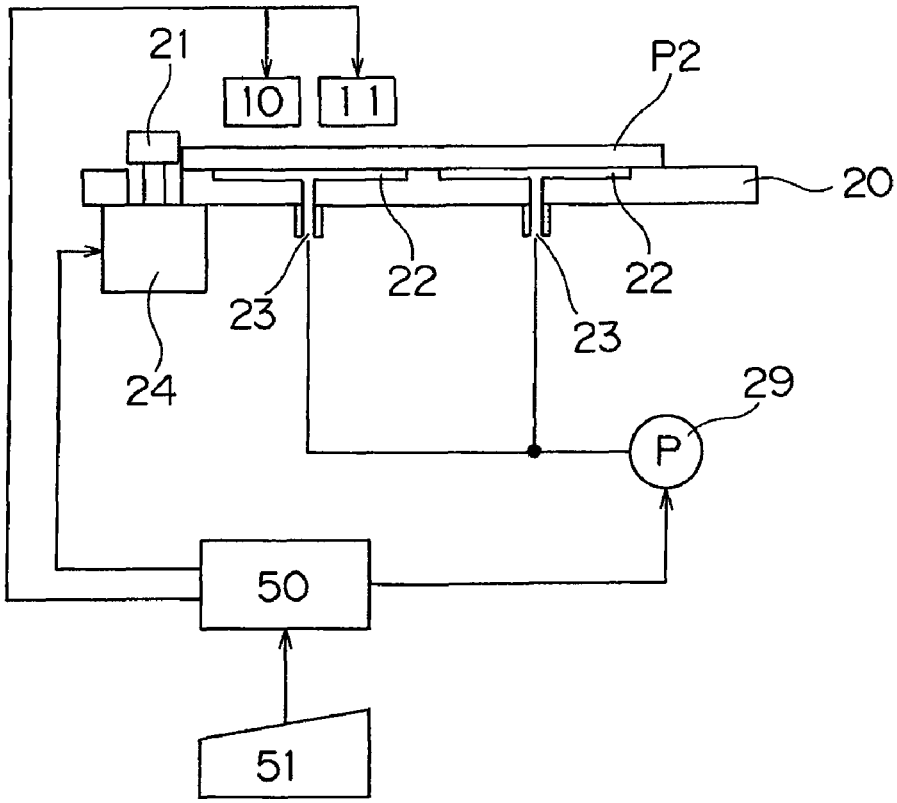
FIG. 3 is a schematic cross-sectional view showing the table 20 and other components.
Figure 4:
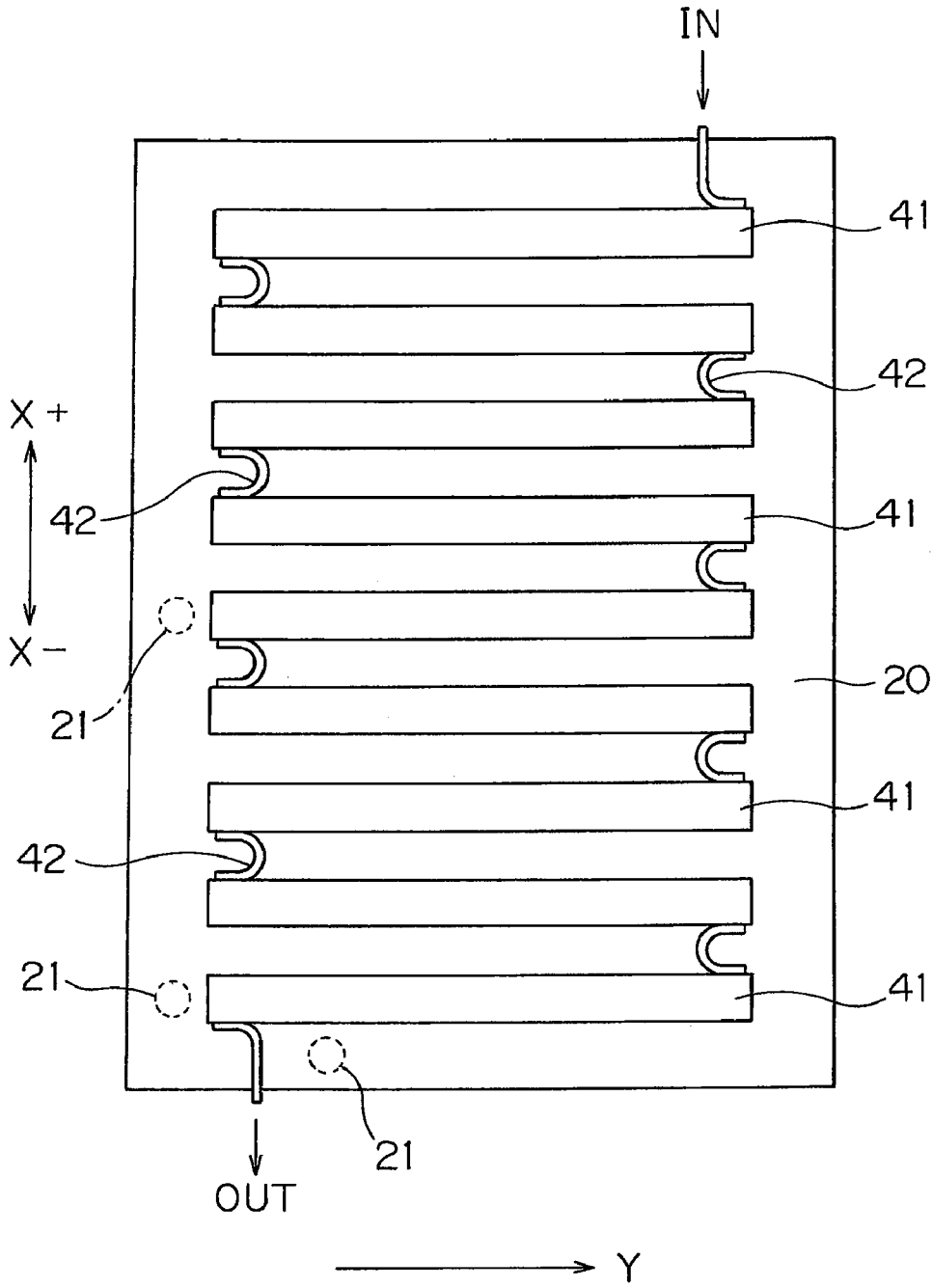
FIG. 4 is a perspective view showing a lower surface of the table 20 which employs a cooling mechanism according to a first embodiment.
Figure 5:
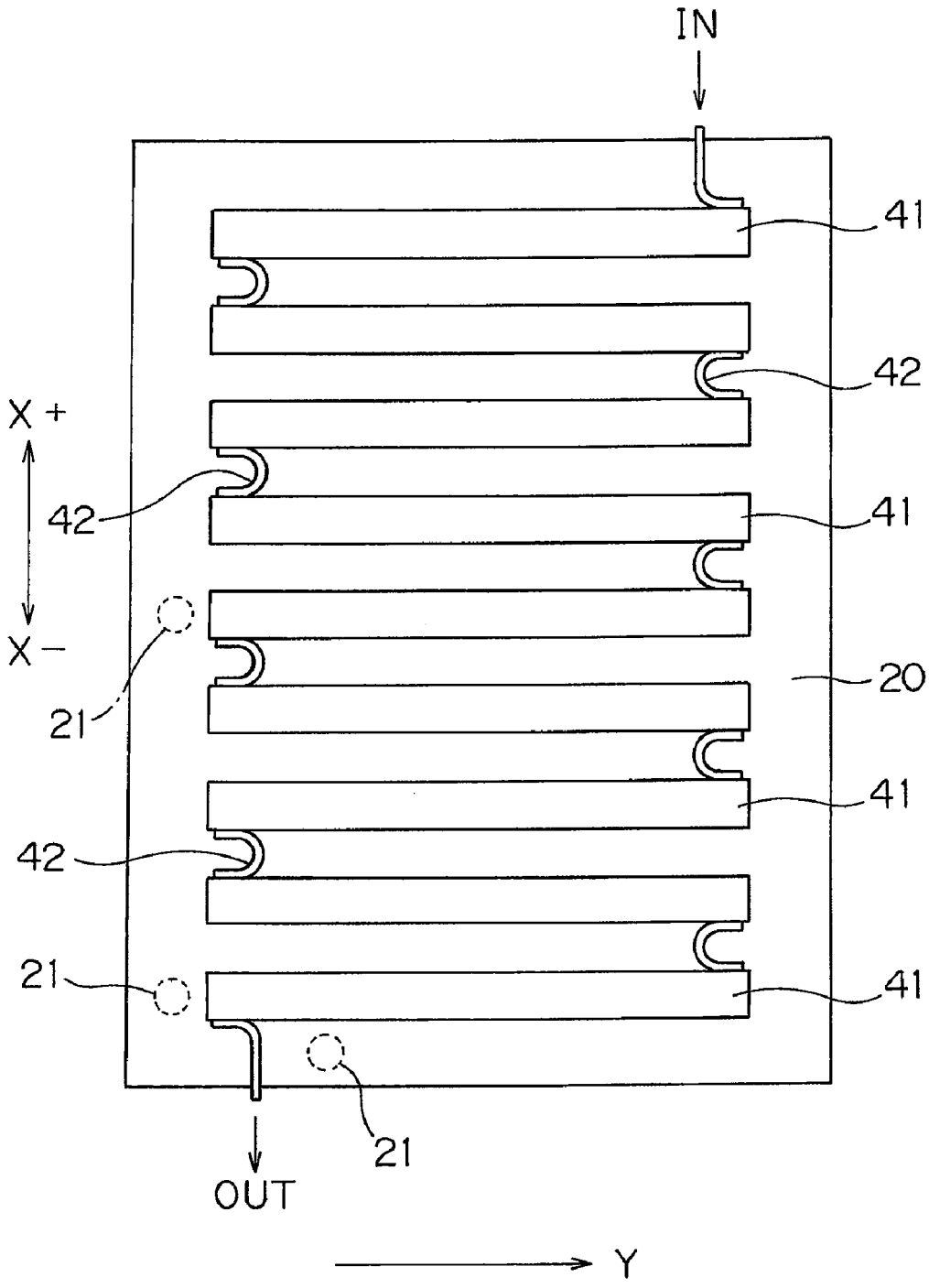
FIG. 5 is a plan view showing the lower surface of the table 20 which employs the cooling mechanism according to the first embodiment.
Figure 6:
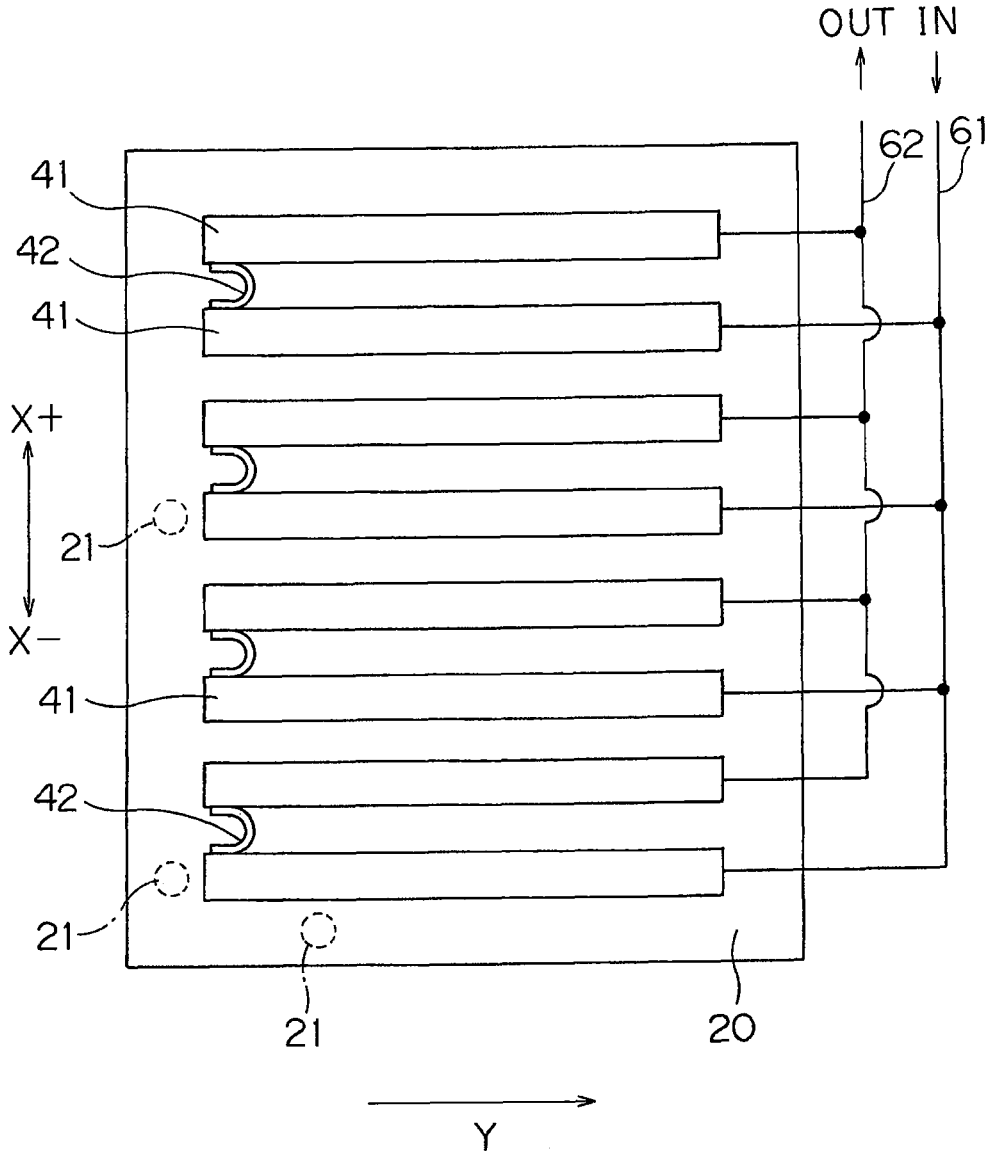
FIG. 6 is a plan view showing a lower surface of the table 20 which employs a cooling mechanism according to a second embodiment.
Figure 7:
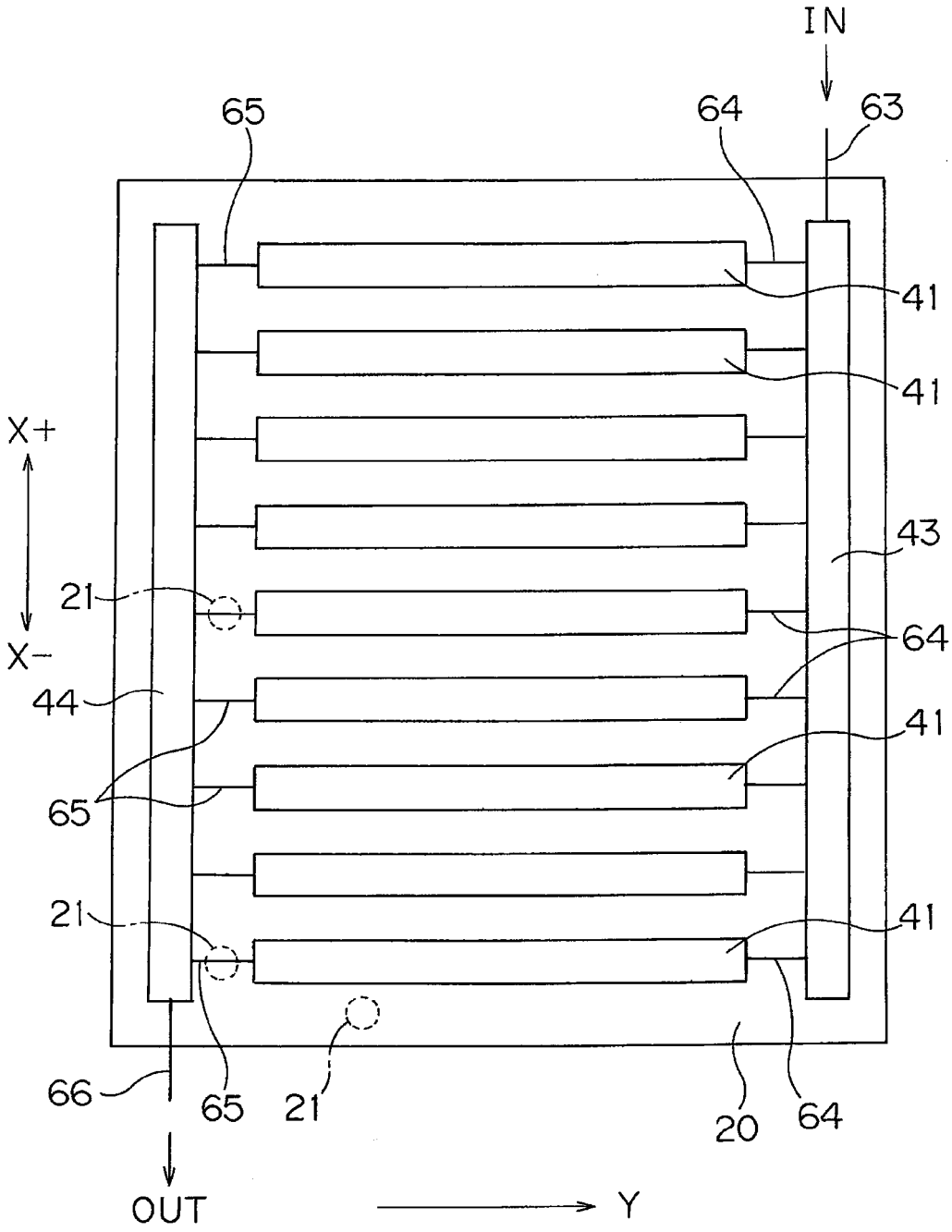
FIG. 7 is a plan view showing a lower surface of the table 20 which employs a cooling mechanism according to a third embodiment.
Figure 8:
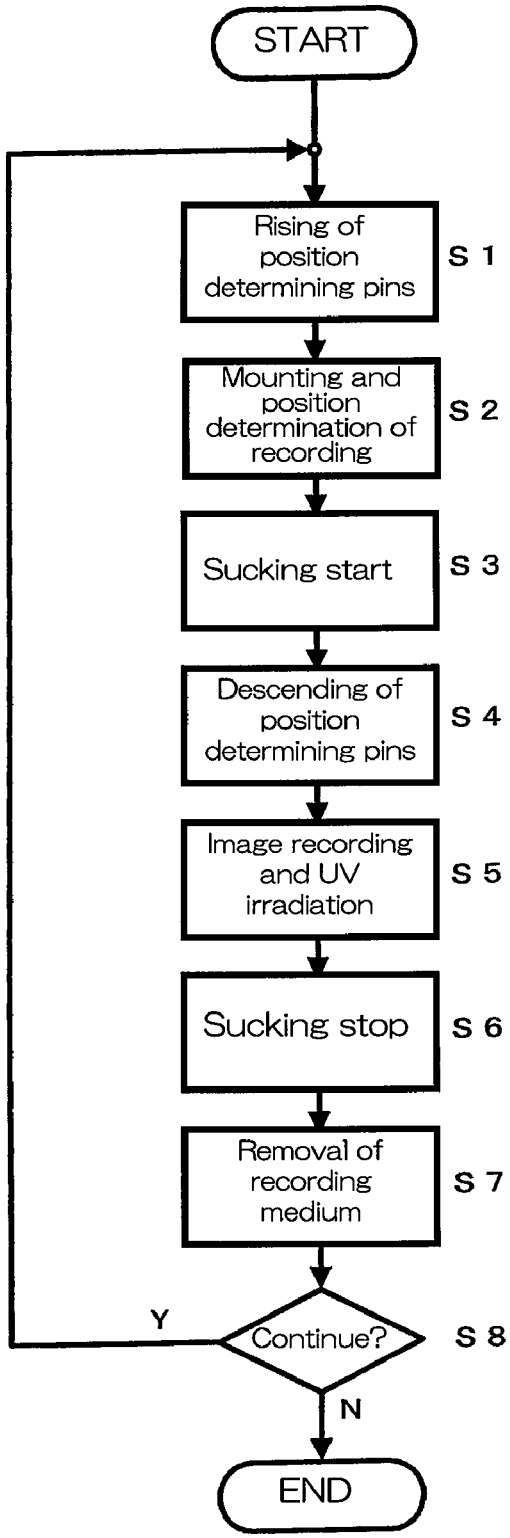
FIG. 8 is a flowchart showing an image recording operation.
Figure 9:
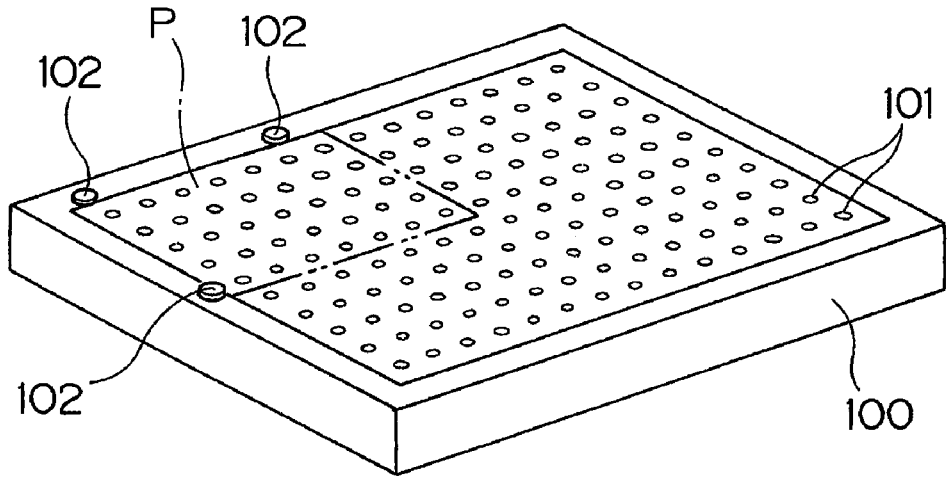
FIG. 9 is a perspective view showing a conventional table 100.
Figure 10:
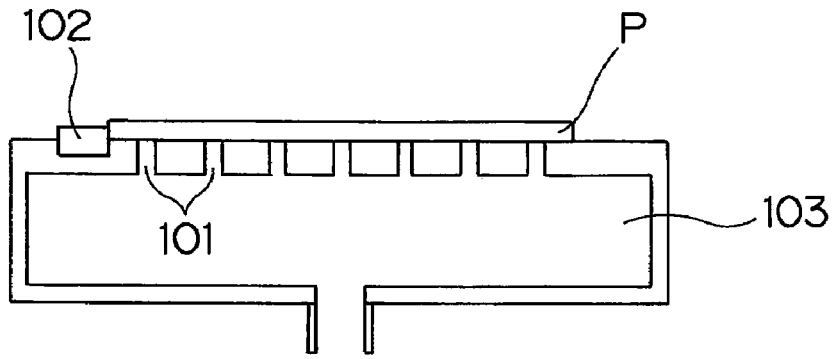
FIG. 10 is a schematic cross-sectional view showing the conventional table 100.

10 Inkjet head
11 UV irradiation mechanism
12 Recording head
13 Discharge duct
20 Table
21 Position determining pin
22 Suction groove
23 Suction hole
30 Main body frame
32 Main scanning guide
33 Auxiliary shaft frame
41 Cooling water passage
42 Tube
43 Supply-side cooling water passage
44 Discharge-side cooling water passage
50 Control part
51 Operation panel
61 Cooling water supply pipe
62 Cooling water discharge pipe
63 Cooling water supply pipe
63 Cooling water discharge pipe
P Recording medium
P1 Recording medium
P2 Recording medium

What is claimed is:

1. An image recording apparatus for recording an image on a recording medium by relatively moving the recording medium and an inkjet head, said image recording apparatus comprising:

an inkjet head;

a table made of a planar member for mounting the recording medium;

fixing means adapted to fixing the recording medium on said table with a suction groove formed on a surface of said table in communication with suction means via a suction hole;

a moving mechanism for relatively moving said inkjet head and said table;

a UV irradiation mechanism for irradiating ink transferred from said inkjet to said recording medium with ultraviolet rays;

a position determining pin for determining a position of said recording medium on said table;

a position determining pin lifting mechanism for lifting up and down said position determining pin relative to said table; and a control part for controlling said position determining pin lifting mechanism, wherein said control part controls said position determining pin lifting mechanism so as to maintain said position determining pin at a state of descending to a position where said position determining pin is not contact with said recording medium at least for a period of UV irradiation to said recording medium by said UV irradiation mechanism;

wherein a cooling mechanism for cooling said table is arranged on a lower surface of said table;

wherein said moving mechanism relatively moves said inkjet head and said table by causing reciprocating movement of said table in one direction and intermittent movement of said inkjet head; and wherein said cooling mechanism has a plurality of cooling water passages extended in a direction transverse to a reciprocating movement direction of said table and a cooling water circulation mechanism for allowing cooling water to pass through said plurality of cooling water passages on a lower surface side of said table.

2. The image recording apparatus according to claim 1, wherein said suction groove has a groove width of 0.7 mm or less and said suction hole has an inner diameter of 1.0 mm or less.

3. The image recording apparatus according to claim 1, wherein said control part controls said position determining pin lifting mechanism so as to raise said position determining pin to a position where said position determining pin is contactable with said recording medium for a period of absence of said recording medium on said table.

4. The image recording apparatus according to claim 1, comprising an arrangement of a plurality of units each including a cooling water passage connected at one end to a cooling water supply pipe and a cooling water passage connected at one end to a cooling water discharge pipe, the other ends of the cooling water passages being connected to one another through a pipe.

5. The image recording apparatus according to claim 1, wherein said plurality of the cooling water passages are each connected at one end to a cooling water supply pipe and connected at the other end to a cooling water discharge pipe.

6. The image recording apparatus according to claim 5, wherein:

said table includes a supply-side cooling water passage arranged along a moving direction of said table and connected to one end of each of said plurality of the cooling water passages and a discharge-side cooling water passage arranged along the moving direction of said table and connected to the other end of each of said plurality of the cooling water passages; and said supply-side cooling water passage and said discharge-side cooling water passage are arranged at both ends in a direction orthogonal to the moving direction of said table.

7. The image recording apparatus according to claim 6, wherein said supply-side cooling water passage or said discharge-side cooling water passage is arranged on an outer side of said position determining pin in said table.

* * * * *